United States Patent [19]

Julson, Jr.

[11] Patent Number: 4,919,026

[45] Date of Patent: Apr. 24, 1990

[54] APPARATUS FOR CUTTING FLEXIBLE MATERIALS

[76] Inventor: Gordon F. Julson, Jr., 2732 S. Burrell St., Milwaukee, Wis. 53207

[21] Appl. No.: 243,984

[22] Filed: Sep. 13, 1988

[51] Int. Cl.[5] ..... B26D 3/12

[52] U.S. Cl. ..... 83/56; 83/438; 83/522.15; 83/544; 83/648; 83/700

[58] Field of Search ..... 83/56, 425, 438, 440.2, 83/444, 467 R, 468, 522, 544–546, 648, 856, 858, 407, 456, 698–700, 579

[56] References Cited

U.S. PATENT DOCUMENTS

| | | | |
|---|---|---|---|
| 187,383 | 2/1877 | Hodson | 83/648 |
| 1,306,992 | 6/1919 | Barrile et al. | 83/648 X |
| 1,873,792 | 8/1932 | Sheeler | 83/544 X |
| 2,273,715 | 2/1942 | Lonskey et al. | 83/438 |
| 2,547,249 | 4/1951 | Bell | 83/648 X |
| 3,005,371 | 10/1961 | Misson | 83/522 X |
| 3,961,551 | 6/1976 | Doyel | 83/648 |
| 4,010,063 | 3/1977 | Natter | 83/544 X |

*Primary Examiner*—Frank T. Yost
*Assistant Examiner*—Eugenia A. Jones
*Attorney, Agent, or Firm*—Foley & Lardner

[57] ABSTRACT

A method and apparatus for cutting a length of flexible material from a web includes, more particularly, a method and apparatus for cutting a predetermined width of carpeting without removing pile fibers from the backing, in a manner which greatly enhances efficiency and productivity.

25 Claims, 3 Drawing Sheets

APPARATUS FOR CUTTING FLEXIBLE MATERIALS

BACKGROUND OF THE INVENTION

1. Technical Field

The present invention relates, generally, to methods and apparatus for cutting a length of flexible material from a web, and, more particularly, to methods and means for cutting a predetermined width of carpeting, without removing pile fibers from the backing, in a manner which greatly enhances efficiency and productivity.

2. Description of the Background Art and Technical Problems

Floor coverings in restaurants, homes, factories, hotels, and offices continue to involve widespread use of flexible webs of material, including vinyl, foamed products, as well as natural and synthetic carpeting. Although colorful patterns have always been popular, modern applications increasuingly employ the use of adjacent strips of differently colored carpeting, or feature stripes, particularly in corridors and around the perimeter of large rooms. Additionally, carpeting is replacing wood as a baseboard and wall covering material.

The appearance of a carpeted surface is largely determined by the manner and quality of installation. However, presently known installation techniques, which have not changed significantly in the past one hundred years, are cumbersome, tedious, strenuous, and time consuming.

Carpeting is typically cut from large rolls into strips at the job site. Small hand-held tools having a generally rectangular, flat, double-edge blade integral therewith, are used almost exclusively to cut carpeting. One corner of the blade protrudes from the tool and is used as the cutter, so that each blade can be inverted as needed to yield four cutting zones per blade. After the surface to be carpeted is measured, the web from which the strip is to be removed is inverted and the appropriate width is marked off on the backside, or underside, thereof. Using a straightedge, the cutting tool is pulled through a length of carpeting, cutting through one or more layers of woven backing (nap), foam, adhesive, or plastic, for example. Inasmuch as carpeting is cut from the backside with the normally exposed pile compressed therebeneath, many individual strands or clusters of fibers are inevitably severed.

When two pieces of cut carpeting are put into place with the cut edges adjacent, it is desirable to conceal the seam therebetween. However, to the extent carpet fibers are removed from both mating edges during cutting, an unsightly seam is created because differences in marginal edges are exaggerated.

Carpet laying is highly labor intensive; contractors are customarily paid by the yard, not by the hour. Thus, it is important to minimize the time required to install a given amount of carpeting. Presently, the cutting procedure generally entails measuring the area to be carpeted; turning the carpet "backside up"; marking the carpet; lining up the straightedge; and pulling the cutter tool along the straightedge. Typically, the cutting zone of a blade remains sharp for perhaps eight to twelve feet of cutting, depending on the composition and structure of the carpeting. Moreover, since the cutting is commonly done on wood, concrete, or tile floors, the blade is easily bent, sheared, or nicked. As a result, considerable time is spent inverting, discarding, and changing blades.

SUMMARY OF THE INVENTION

The present invention provides methods and apparatus for cutting a strip of flexible material of a predetermined width from a web thereof, in a manner which greatly enhances quality and efficiency. A preferred embodiment of the present invention provides an apparatus for cutting the primary and secondary backing of carpeting without severing the pile, or at least significantly reducing such tendencies. This is accomplished in one aspect of the invention by providing a flat, generally rectangular carrier or bracket having a lower surface adapted to slide along the floor and an upper supporting surface, or deck, over which a web of carpeting is directed during cutting. A blade holder, rigidly connected to the aft portion of the deck, presents the vertical leading edge of a thin, flat, rectangular blade substantially orthogonal to the plane of the web. Sufficient clearance is provided in the blade holder slot to allow the blade to reciprocate up and down, at high frequency and low amplitude, during the cutting process. This relative movement between the blade and the carpet is substantially confined to the plane of the blade and results in a sawing action. Consequently, carpeting having a thick backing can be cut with relative ease, thus promoting higher productivity. In addtion, the fact that the pile in the vicinity of the freshly cut edge is left intact allows for nearly perfect seams between adjacent segments.

DETAILED DESCRIPTION OF PREFERRED EXEMPLARY EMBODIMENTS

Figure 1:
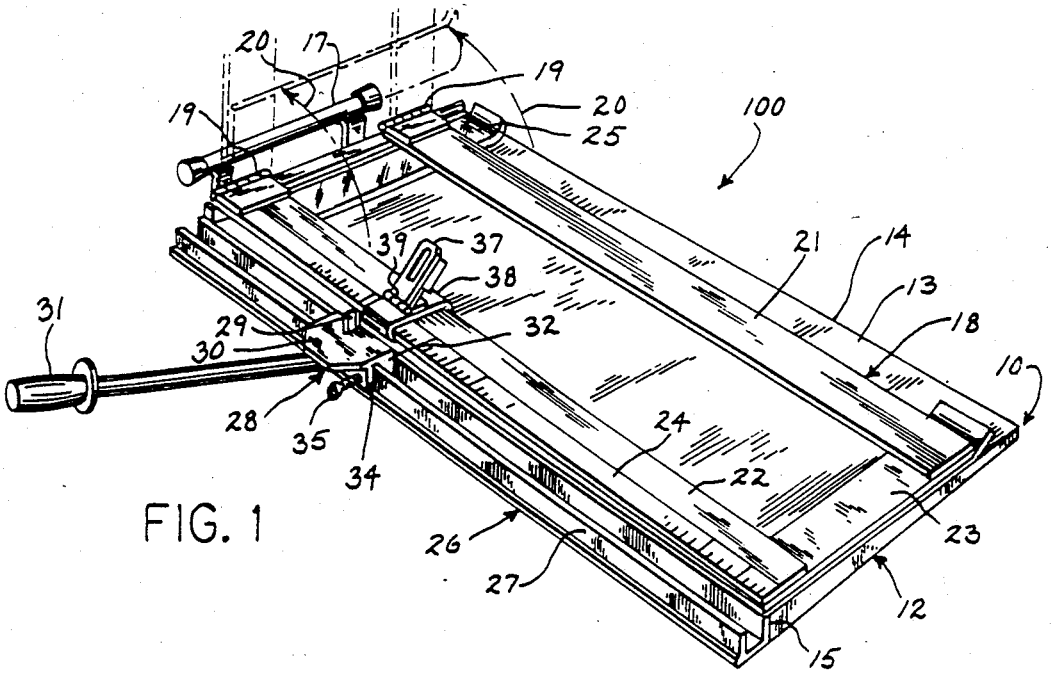
FIG. 1 is a perspective view of an apparatus in accordance with the present invention, configured for cutting flexible material.
Figure 3:
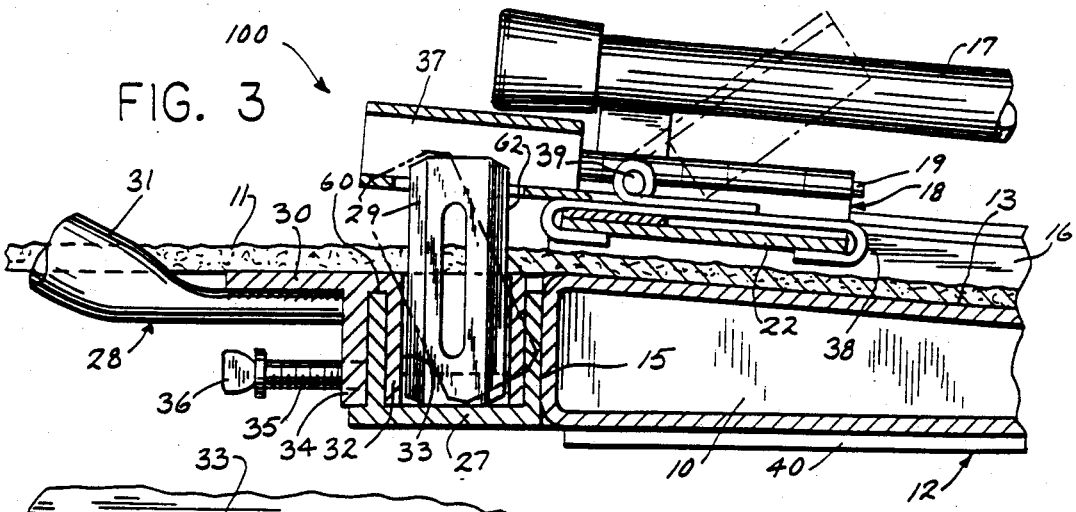
FIG. 3 is an enlarged sectional view taken generally along the line 3—3 of FIG. 2.
Figure 6:
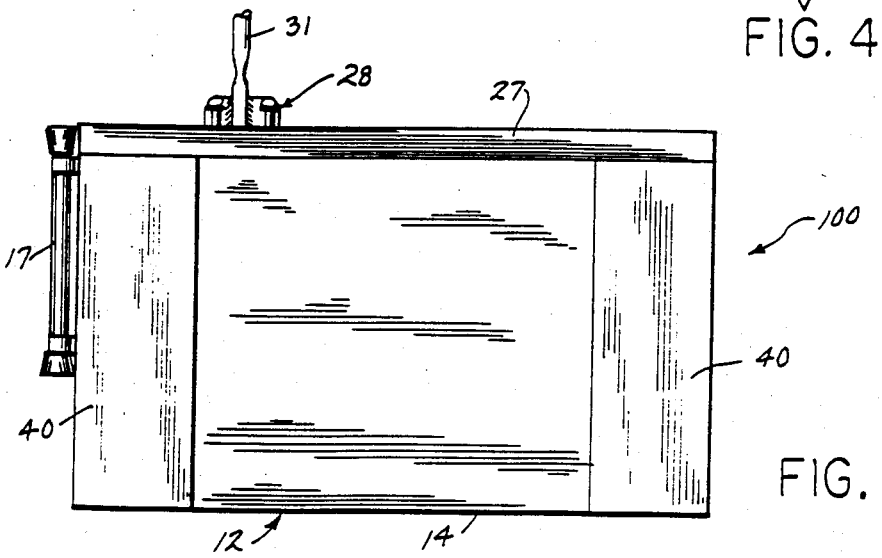
FIG. 6 is a bottom plan view of the apparatus of FIG. 1.

Referring to FIGS. 1, 3 and 6, a cutting machine 100 generally comprises a carrier 10, including a base 12 and a deck 13 over which a web of carpeting or other flexible material is directed for cutting.

In a preferred embodiment, carrier 10 is generally rectangular as viewed in plan and may be inclined upwardly from the front edge 14 thereof to provide an entry ramp for web 11. If desired, the deck 13 may incline upwardly over the full distance from a front transverse, or fore edge 14, to a rear transverse or aft edge 15. To one side, deck 13 is provided with a generally upright, longitudinally (i.e., fore-and-aft) extending guide surface 16 for engagement by an edge of web 11 while passing through machine 100 during a cutting operation. Disposed outwardly from and generally paralleling the plane of guide surface 16, carrier 10 is also provided with a longitudinal or fore-and-aft extending handhold member 17.

Rearwardly of carrier 10 and secured to the aft section thereof is provided a transversely extending track 26, which, according to a preferred embodiment of the invention, includes an upwardly opening channel member 27 that extends the full transverse dimension of carrier 10. A handle assembly 28 is engageable with track 26 and carries a cutting blade 29 for cutting material 11 moving relative thereto, as more fully described hereinafter.

Handle unit 28 comprises a plate member 30 and a rearwardly extending handle 31. Generally normal to handle 31, plate member 30 includes a transversely extending depending member 32 which slidably engages channel member 27. With depending member 32 properly engaged within channel 27, the upper surface of plate member 30 is generally parallel to base member 12.

Figure 5:
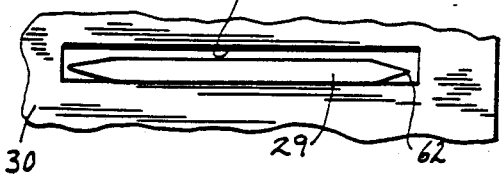
FIG. 5 is an enlarged fragmentary plan view of the cutting member, shown as a blade disposed in a blade slot or recess.

Plate member 30 and depending member 32 are provided with a fore-and-aft extending slot or recess 33 for retaining cutting blade 29 (see FIG. 5). Blade 29 is suitably disposed in slot 33 with a leading edge 62 facing forward edge 14 of bracket 10. Slot 33 is generally upright with an upper opening terminating at plate 30 and a lower opening terminating at channel 27. Thus, when disposed in slot 33, blade 29 rests on the generally flat, transverse bottom portion of channel member 27 and projects upwardly substantially above plate member 30, as shown in FIG. 3. For reasons more fully described hereinafter, the transverse dimension of slot 33 preferably exceeds the thickness of blade 29 by about 0.001 to 0.125 inches, and more preferably by about 0.002 to 0.005 inches. The fore-and-aft dimension of slot 33 preferably exceeds the width of blade 29 by about 0.001 to 0.050 inches, and more preferably by about 0.015 to 0.020 inches.

Conventional cutting blades presently used in the hand-held cutting tools discussed supra may be advantageously employed in a preferred embodiment of the present invention. Exemplary blades, generally corresponding to blade 29, are desirably approximately 2.25 inches high (the leading edge); 0.750 inches wide (the fore-and-aft direction of slot 33); and 0.015 inches thick. Thus, slot 33 may advantageously have a fore-and-aft dimension in the range of about 0.750 to 0.800 inches (preferably 0.750 to 0.765 inches), and a transverse dimension in the range of about 0.015 to 0.065 inches (preferably 0.017 to 0.020 inches).

Blade 29 is a double-edged blade so that it may be rotated 180 degrees to present a fresh edge once an active cutting edge is worn. Since less than half of blade 29 projects above plate member 30 for cutting, the blade can also be inverted to present a fresh cutting edge.

The edges of blade 29 are extremely sharp so that protection against possible unwitting cutting accidents are considered appropriate. To reduce the tendency for such accidents, a pivotal cover member 37 can extend down over the upper extremity of blade 29. As shown in FIG. 3, the cover member 37 also remains well above the material 11 being cut and out of contact with the blade so that it does not interfere with the cutting operation. Cover member 37 is mounted on carriage 38 which in turn is slidably disposed on a rear hold-down slat 22 (discussed below). To provide access to blade 29 when desired, cover member 37 is pivoted on a transverse hinge 39 to the position shown in phantom lines in FIG. 3. Alternatively, the blade guard may extend along the entire length of slat 22, and comprise a semicircular member made from a synthetic polymer, for example, "plexiglass."

Figure 2:
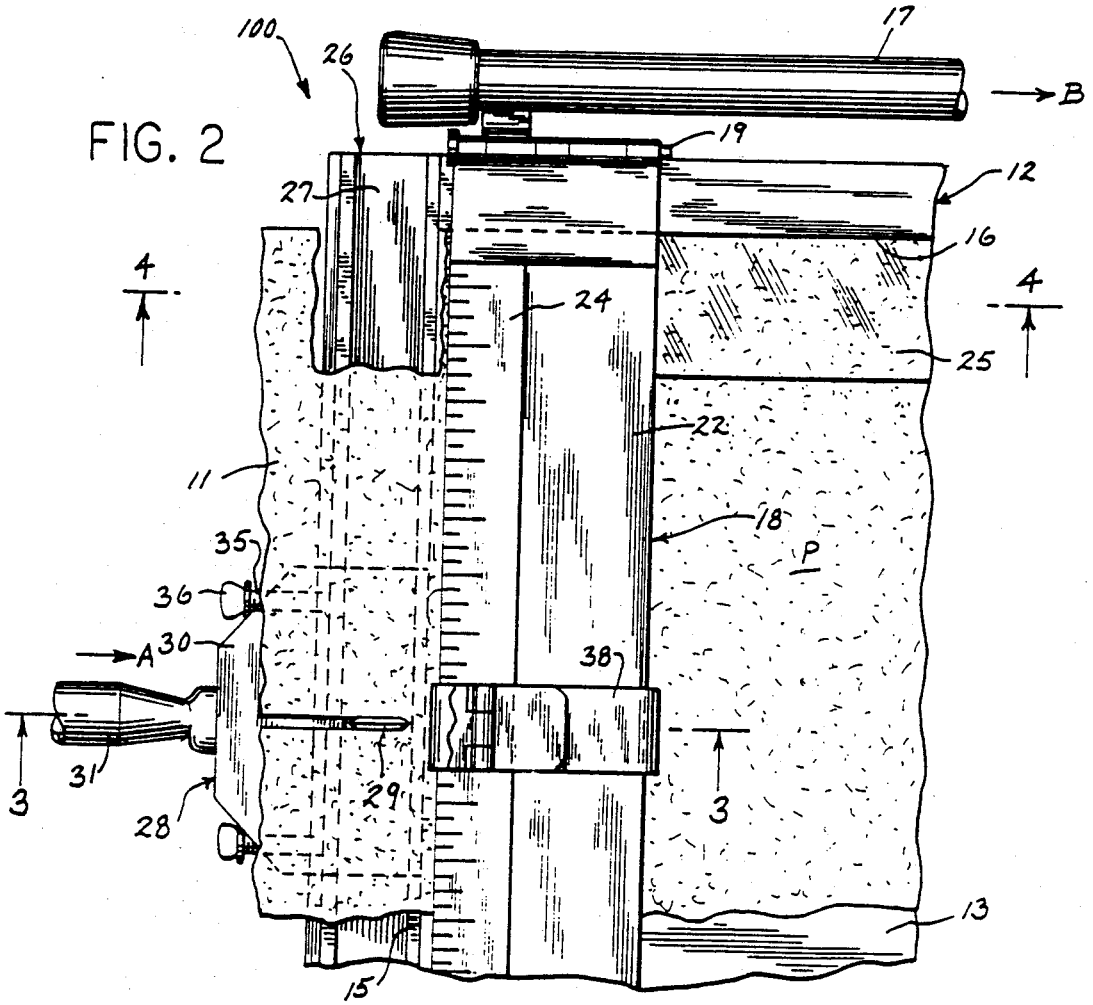
FIG. 2 is an enlarged fragmentary plan view of the apparatus of FIG. 1, shown during operation moving relative to and cutting a strip of flexible material such as carpeting.

Referring now to FIGS. 1, 2, and 3, a generally rectangular hold-down member 18 is pivotally connected to carrier 10, for example by respective hinges 19, to aid in the control of the material moving through the apparatus. In the normally down position, hold-down member 18 extends across the surface of deck 13 between hinges 19 and the oppositely disposed fore-and-aft edge of carrier 10. Hold-down member 18 may be raised or pivoted upwardly to an open position relative to deck 13, as indicated by the arrows 20 in FIG. 1, to facilitate placement of web 11 on deck 13 prior to cutting.

Hold-down member 18 preferably comprises a lattice structure and includes a pair of generally parallel, transversely extending slat members 21 and 22 having distal ends remote from hinges 19 and connected by a cross-member 23. The forwardly disposed slat member 21 is spaced somewhat rearwardly from front edge 14 of deck 13 as generally shown in FIG. 1. A preferably transparent, plastic cross-member 25 is carried by slat member 21 and extends beneath rear slat member 22 adjacent guide surface 16. The lower surface of cross-member 25 is disposed generally normal to the guide surface 16 and serves to prevent the material 11 from creasing and/or curling relative to the guide surface. In view of its lattice construction, the hold-down member 18 exerts relatively little bearing pressure on web 11 passing therebeneath. Cross-member 25 makes it possible to watch and/or monitor the material 11 being conducted through the machine 100 for cutting, particularly as to its relation to the guide surface 16. A linear scale 24 may be advantageously disposed along the rear edge of the slat member 22 to provide a distance measure in the transverse direction across the deck 13 relative to the guide surface 16.

The rear edge of rearwardly disposed slat member 22 generally coincides, vertically, with the rear edge 15 of deck 13. In this way, an imaginary line defined by leading edge 62 of blade 29 (i.e., L-L as best viewed in FIG. 8) may be held substantially perpendicular to an imaginary plane defined by web 11 (P as viewed in FIG. 2) proximate the cutting site during the cutting operation. This minimizes the resistance to cutting exhibited by web 11 to the extent that the portion of leading edge 62 which engages web 11 is limited to the thickness of web 11. Furthermore, an orthogonal orientation of edge 62 with respect to the plane of web 11 reduces the likelihood that web 11 may become pinched between edge 62 and plate 30 during cutting, as may otherwise occur if edge 62 were disposed at an acute angle with respect to the uncut portion of web 11. Alternatively, blade 29 may be disposed at an obtuse angle with respect to the uncut portion of web 11, as shown in phantom lines in FIG. 3.

Plate member 30 is suitably provided with a depending rib 34 which is spaced rearwardly from member 32 by a distance corresponding to at least the thickness of a flange 60 forming an aft boundary of channel member 27. A pair of tap screws 35, having respective heads 36 adapted for finger manipulation, are spaced on opposite sides of handle 31 and threadedly engaged in rib 34. Screws 35 may be manually turned to engage the adjacent flange of channel 27 to secure handle unit 28 relative to deck 13.

When the cutting machine is not in use, handle unit 28 is generally separated from the base member 12 for more convenient storage and transportation. When the machine is to be placed in service, handle unit 28 is reassembled to carrier 10. To reassemble handle unit 28 to carrier 10, depending member 32 of handle unit 28 is initially engaged in channel 27. Thereafter, handle unit 28 is slidably manipulated to align blade slot 33 to the desired linear dimension on scale 24 to provide for the needed width of material 11 as measured from the guide surface 16. After blade slot 33 is properly aligned relative to scale 24, handle unit 28 is locked in position by tightening the screws 35 against the flange of the channel 27.

Alternatively, handle unit 28 may be permanently mounted to deck 13 and guide 16 may be extendable from deck 13, for example by rollers or bearings (not shown). In that event, a scale, similar to scale 24, may be disposed on a sliding member interposed between guide 16 and bracket 10 to establish a desired predetermined distance between guide 16 and blade 29. A mechanism similar in function to screws 35 having heads 36 may be incorporated into guide 16 to maintain the position thereof at the desired distance from blade 29.

With machine 100 set to cut the proper width, one end of material 11 is manipulated onto deck 13 beneath hold-down member 18 with the side edge of the material abutting guide surface 16. Cutting blade 29 is inserted into slot 33 and cover member carriage 38 slidably manipulated into position on rear hold-down slat 22 so that cover member 37 can be pivoted into protective position over the blade.

Figure 4:
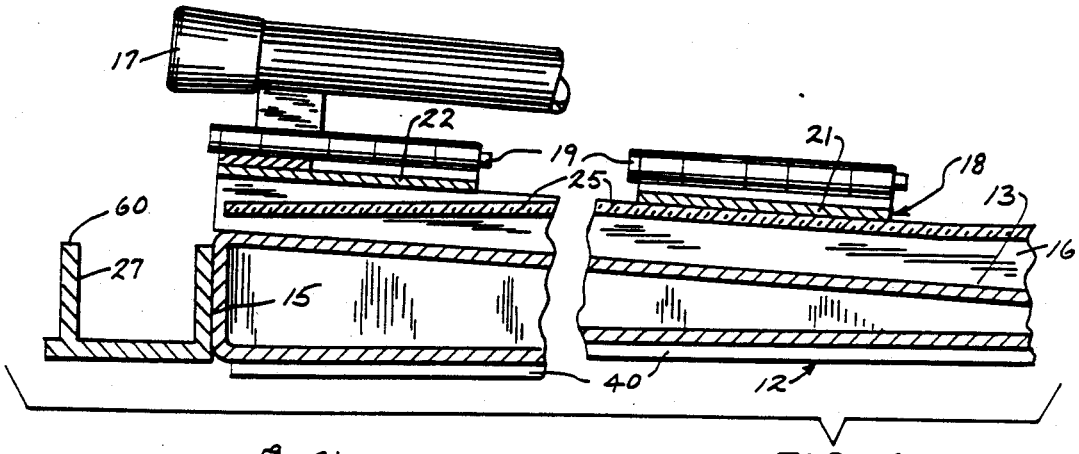
FIG. 4 is a sectional view taken generally along the line 4—4 of FIG. 2.

With material 11 properly loaded into cutter 100 and cutting blade 29 in place, the machine is set for cutting. Cutting is advantageously effected by an operator working on the floor, by moving the cutting machine 100 relative to web 11 as indicated in FIG. 2 by the arrows A and B. Movement of the machine is generally effected by pushing the same with one hand on handle 31 and the other on base member hand-hold 17. As web 11 is cut to form a pair of strips, handle 31 moves therebetween. Ordinarily, the cutting machine will cut material as fast as the operator is able to move the machine. To enhance the speed of operation of the machine, the bottom of base member 12 may be provided with fore-and-aft extending runners 40 as shown in FIGS. 4 and 6, preferably coated with a low friction composition such as PTFE.

If desired, cutting a web of material may alternatively be effected by pulling the material through the machine. While the operator holds and monitors machine 100 in a generally fixed position, a helpmate pulls the two severed strips of material 11 relative to the machine.

When web 11 is carpeting or a similarly flexible material, it has been observed that blade 29 reciprocates up and down relative to the web during cutting. This motion is induced in the blade by (relative) movement of the web through the apparatus. Although the precise mechanism by which this occurs is not fully appreciated, it is desirable to maintain the dimensions of slot 33, as discussed above, to afford blade 29 the necessary freedom to vibrate. Blade 29 rests on channel 27 while retained in slot 33, but is not otherwise secured to cutting apparatus 100.

It is generally desirable for handle unit 28 to remain rigidly attached to the aft portion of bracket 10, so that no relative movement may occur therebetween. This ensures proper alignment of blade 29 with respect to the web during use.

Inspection of blade 29 after cutting reveals that an area of its leading edge, which are is longer than the thickness of the web, is marred during cutting. This suggests that the blade, the web, or both "jump" up and down during cutting. When blade 29 is constrained, for example by manual application of pressure with a finger, the resistance to cutting is increased. This is presumably because the relative movement between the blade and the web is impeded. Thus, although it is desirable for blade 29 to vibrate up and down in recess 33, satisfactory results may be obtained as long as limited relative motion between the blade and the web is permitted. This sawing action, somewhat akin to the motion of a saber saw blade, apparently results from the interaction between the sharp blade and the relatively unconstrained width of the flexible web.

An important advantage of the present invention is that relatively few nap fibers are cut by blade 29 in machine 100; the blade appearing to select a path of least resistance through the material to the extent provided or permitted by the clearance allowed in slot 33. In view of the relatively few pile fibers that are cut and the accuracy with which machine 100 cuts, when the machine-cut edges of two pieces of carpeting are brought together, a seam is often not detectable or, at most, only faintly observable after the fibers at the joint are brushed slightly.

A carpeting installer working with the cutting machine described herein can cut carpeting many times faster than with the common hand-held tool used in combination with a straight edge. Since cutting blade 29 is not subjected to dulling contact with wood, concrete, or other hard surfaces, each blade is capable of cutting up to hundreds of feet before a replacement is necessary. When cutting blade 29 requires reversing, inverting or replacing in cutting machine 100, the worn blade is simply removed and a fresh blade dropped into slot 33, as opposed to the time consuming disassembly and reassembly associated with the small hand-held tool. Thus, operation of cutting machine 100 involves minimal unproductive lost time.

Figure 7:
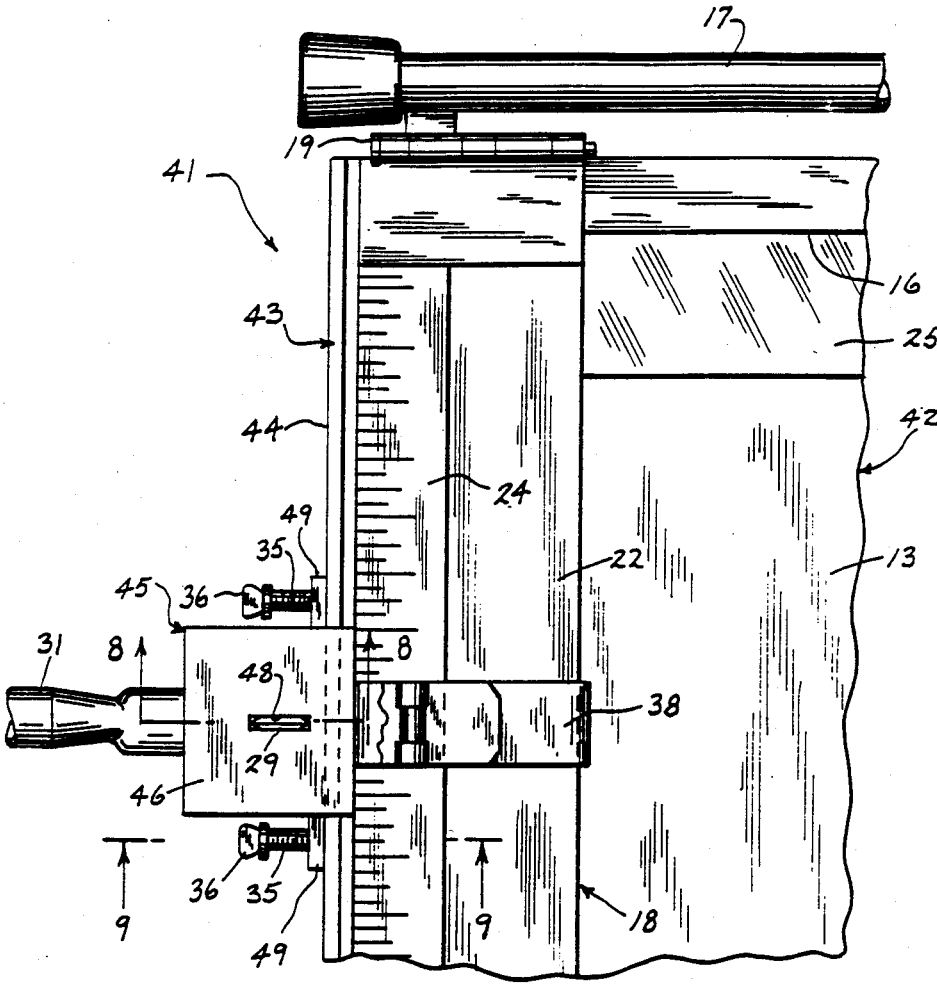
FIG. 7 is a fragmentary plan view of another embodiment of an apparatus in accordance with the present invention.
Figure 8:
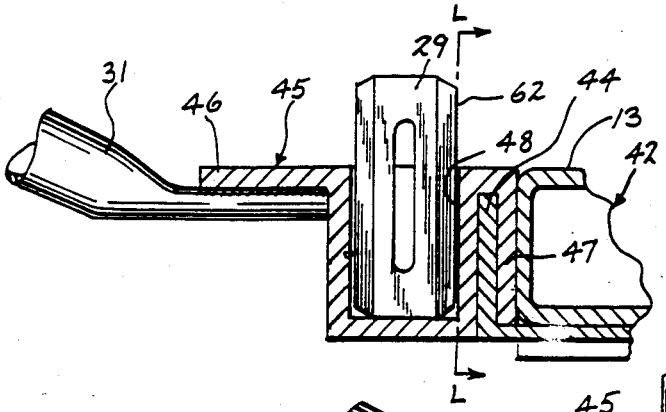
FIG. 8 is a sectional view taken generally along the line 8—8 of FIG. 7.
Figure 9:
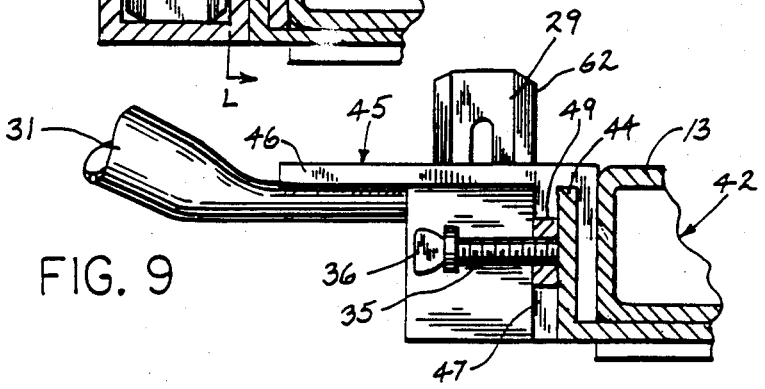
FIG. 9 is a sectional view taken generally along the line 9—9 of FIG. 7.

Turning now to the embodiment of FIGS. 7-9, like reference numerals on a cutting machine 41 indicate general correspondence with the similar elements described in connection with cutting machine 100. A carrier 42 for cutting machine 41 terminates rearwardly with a track 43 that takes the form of a transversely extending rib 44 for engagement by a detachable handle unit 45. Rib 44 is spaced from deck 13 and generally extends the full transverse dimension of base member 42.

A handle unit 45 comprises a plate member 46 that rearwardly mounts handle 31. Forwardly, plate member 46 is provided with a depending, downwardly opening transversely extending channel member 47. Channel member 47 is engageable upon, and receives therein, the rib 44. With channel member 47 properly engaged upon rib 44, the upper surface of plate member 46 generally corresponds to the height of deck 13 of carrier 42. Generally in the vertical plane of the axis of handle 31 and rearwardly of channel member 47, plate member 46 is provided with a fore-and-aft extending slot 48 for receiving the cutting blade 29. As shown in FIG. 8, slot 48 is closed at the bottom so that cutting blade 29 is fully contained by handle unit 45.

Handle unit 45 is engaged upon and adjusted relative to linear scale 24 and thereafter secured in the desired position in a manner generally similar to that described in conjunction with handle unit 28. For its securement, handle unit 45 is provided with respective lateral projections 49 that extend from a rear flange of channel member 47. Screws 35 are threadedly engaged in projections 49 and are manually adjusted to engage with rib 44 to secure handle unit 45 onto carrier 42.

Cutting machine 41 operates generally similarly to machine 100 and offers all of the advantages described with reference to it.

Those skilled in the art will appreciate that the degree of flexibility exhibited by a web of material suitable for use in the cutting machine described herein may vary greatly. Thus, although a preferred embodiment is described with reference to a web of carpeting, the foregoing advantages may also be obtained in conjunction with, for example, wallpaper, roofing, shingles, ceiling tiles, fabric, leather, foam, quilts, tar paper, cardboard, fiberboard, plastic, foamboard, paper, matt board, and vinyl base.

It will be understood that the foregoing description is of preferred, exemplary embodiments of the present invention and that the invention is not limited to the specific forms shown. For example, guide 16 may be modified or omitted when it is desired to cut other than in a straight line. If, for example, a particular pattern is to be cut, the operator may guide the machine along a pattern line, keeping the blade aligned therewith. Furthermore, triangular, curved, or any other sharp-edged blade configuration may be employed, to the extent that at least a limited degree of relative motion between the blade and the web is permitted. These and other modifications may be made in the design and arrangement of the components without departing from the spirit of the invention as expressed in the appended claims.

I claim:

1. A method of cutting a web of flexible material, comprising the steps of:

securing a blade holder to a deck over which said web is to be directed;

disposing a thin, flat blade in said holder, said holder having a trans verse dimension exceeding the thickness dimension of said blade by an amount in the range of about 0.001 to 0.125 inches, such that said blade is substantially unconstrained within said holder;

inducing said blade to move with respect to said web in response to said web moving relative to said blade, such that said blade exhibits an up and down motion relative to said web, thereby sawing through said web.

2. An apparatus for cutting a web of flexible material, comprising:

carrier means for supporting said web of flexible material to be cut;

cutting means, having a leading edge disposed in severing relation to said web, for cutting a web of material, said material comprising a backing and a plurality of fibers extending therefrom, said cutting means further including recess means, rigidly attached to said carrier means, for retaining said leading edge therein in an unsecured manner;

said cutting means and said carrier means being disposed to permit reciprocating relative motion between said leading edge and said web, induced by the travel of said web with respect to said cutting means.

3. The apparatus of claim 2, wherein said carrier means comprises a generally rectangular base member and a generally rectangular deck integral with said base member, said deck being disposed at an inclined angle with respect to said base member.

4. The apparatus of claim 3, wherein fore-and-aft extending runners are provided beneath said base member.

5. The apparatus of claim 4, wherein said runners are coated with a low friction composition.

6. The apparatus of claim 2, further comprising:

a hold-down member pivotally connected to said carrier means on a fore-and-aft extending axis thereof, said hold-down member being substantially parallel to said deck in the down position such that said web is received therebetween.

7. The apparatus of claim 6, wherein said hold-down member comprises a lattice structure which imposes a relatively light bearing pressure on said web as said web is directed over said deck during cutting.

8. The apparatus of claim 7, further comprising:

a generally upright guide means, cooperating with said deck, for guiding a side edge of said web, said guide means extending in the fore-and-aft direction of said deck.

9. The apparatus of claim 8, wherein said hold-down member further comprises restricting means, adjacent to said guide means, for inhibiting curling of said edge of said web as said web is directed over said deck.

10. The apparatus of claim 8, further comprising:

a linear scale mounted adjacent the aft portion of said deck and providing a distance measure from said guide means.

11. The apparatus of claim 10, wherein a handle assembly is detachably mounted to a track disposed aft said carrier means such that a predetermined desired distance may be established and maintained between said cutting means and said guide means.

12. The apparatus of claim 3, further comprising a fore-and-aft extending side handle mounted to a side edge of said deck.

13. The apparatus of claim 2, further comprising pivotably mounted guard means for covering a substantial portion of said cutting means.

14. The apparatus of claim 13, wherein said guard means extends substantially over the transverse length of said deck.

15. The apparatus of claim 2, wherein said cutting means comprises a blade and said recess means comprises a slot having a transverse dimension which exceeds the thickness of said blade by an amount in the range of about 0.001 to 0.125 inches.

16. The apparatus of claim 12, wherein said slot has a fore-and-aft dimension which exceeds the fore-and-aft dimension of said blade by an amount in the range of about 0.001 to 0.050 inches.

17. The apparatus of claim 2, wherein at least about one-half of the length of said leading edge of said cutting means is retained in said recess means.

18. The apparatus of claim 2, wherein said cutting means comprises a blade and said recess means comprises a slot having a fore-and-aft dimension which exceeds the width dimension of said blade by an amount in the range of about 0.015 to 0.020 inches, said slot also having a transverse dimension which exceeds the thickness of said blade by an amount in the range of about 0.002 to 0.005 inches.

19. The apparatus of claim 2, further comprising a transversely extending track aft of said carrier means, said track comprising a substantially U-shaped channel.

20. The apparatus of Claim 19, further comprising a handle assembly, including:

a handle extending rearwardly from said assembly in the fore-and-aft direction of said deck;

a depending member for receipt within said channel; and a plate member rigidly connected to said depending member and said handle, said recess means being disposed within and integral with said plate member and said depending member.

21. The apparatus of Claim 20, wherein, said cutting means is received within said recess means such that said cutting means rests on said channel, but is not otherwise rigidly secured therein.

22. An apparatus for cutting a web of flexible material, comprising:

carrier means for supporting a web to be cut as said web relatively moves from a fore to an aft end of said carrier means during cutting;

a thin, flat blade having a leading edge for cutting said web;

retaining means for holding said leading edge substantially orthogonal to said web in the vicinity of the cutting site, such that said blade moves in a sawing motion through said web as a result of said web relatively moving fore to aft of said carrier means during cutting engagement with said blade.

23. An apparatus for cutting a web of flexible material, comprising:

carrier means for supporting a web to be cut;

a thin, flat, blade having a leading edge for cutting said web at a cutting site; and recess means, rigidly connected to said carrier means, for holding said blade, wherein: therein in an unsecured manner such that said blade moves in a sawing motion through said web as a result of said web relatively moving fore to aft of said carrier means during cutting engagement with said blade

24. An apparatus for cutting a web of flexible material, comprising:

carrier means having fore-and-aft ends for supporting a web to be cut;

a thin, flat, cutting blade having a leading edge for cutting said web at a cutting site;

slot means for retaining said blade, said therein in an unsecured manner such that said blade moves in a sawing motion through said web as a result of said web relatively moving fore to aft of said carrier means during cutting engagement with said blade defined by said blade, said first and said second planes being substantially orthogonal; and a first imaginary line defined by said leading edge of said blade is disposed at an angle of at least about ninety degrees with respect to a second imaginary line lying in said first and said second planes, said second imaginary line extending from said cutting site toward the uncut portion of said web.

25. An apparatus for cutting a length of carpet having a backing and a plurality of fibers extending therefrom, the apparatus comprising:

a carrier having an inclined deck over which said carpet is guided from the front to the back of said carrier during cutting of said carpet;

a thin, flat, blade having a leading edge for cutting said carpet at a cutting site;

a vertically extending slot for holding said leading edge proximate said carpet at said cutting site, said slot being configured such that said blade and said carpet oscillate relative to one another at high frequency and low amplitude during cutting, said slot having a fore-and-aft dimension exceeding that of said blade by an amount in the range of about 0.015 to 0.020 inches and a transverse dimension exceeding that of said blade by an amount in the range of about 0.002 to 0.005 inches, said fore-and-aft and said transverse slot dimensions being selected to facilitate said oscillating motion;

a hold-down member, pivotally mounted to a side of said carrier, for maintaining said carpet in a substantially horizontal plane as said carpet moves relative to said carrier such that said carpet is substantially orthogonal to said leading edge;

a transversely extending track aft of said carrier means, said track comprising a substantially U-shaped channel;

a depending member for receipt within said channel, said slot being disposed integral with said depending member such that said blade rests on said channel but is not otherwise secured within said slot; and a handle, cooperating with said carrier, for guiding the apparatus relative to said carpet.

* * * * *